US006430849B1

(12) United States Patent
Underwood

(10) Patent No.: US 6,430,849 B1
(45) Date of Patent: Aug. 13, 2002

(54) COMBINATION BUCKET/BREAKER APPARATUS FOR EXCAVATOR BOOM STICK

(76) Inventor: Lowell A. Underwood, P.O. Box 452, Prosper, TX (US) 75078

( * ) Notice: Subject to any disclaimer, the term of this patent is extended or adjusted under 35 U.S.C. 154(b) by 0 days.

(21) Appl. No.: 09/624,099

(22) Filed: Jul. 24, 2000

(51) Int. Cl.[7] ..... E02F 3/76; E02F 3/96
(52) U.S. Cl. ..... 37/403; 37/408; 37/410
(58) Field of Search ..... 37/408, 410, 403, 37/234, 405, 406, 407, 409; 91/511, 517

(56) References Cited

U.S. PATENT DOCUMENTS 3,865,013 A * 2/1975 Mastaj
4,070,772 A * 1/1978 Motomura et al.
4,100,688 A * 7/1978 Grist
5,689,905 A * 11/1997 Ibusuki
6,085,446 A * 7/2000 Posch
6,269,560 B1 * 8/2001 Pratt

OTHER PUBLICATIONS

Komatsu Mini–Excavator PC03–2F Brochure Sheets (4/00).

* cited by examiner

*Primary Examiner*—Christopher J. Novosad
(74) *Attorney, Agent, or Firm*—John G. Fischer

(57) ABSTRACT

An excavating machine, representatively a tracked excavator has a boom stick portion on which both an excavating bucket and a hydraulic breaker are mounted for hydraulically driven pivotal movement between first and second limit positions. With the breaker in its first limit position, the bucket may be swung away from its first limit position and used independently of the breaker for digging operations. Similarly, with the bucket in its first limit position, the breaker may be swung away from its first limit position and used independently of the breaker for refusal material-breaking operations. Thus, the same excavating machine may be used for both digging and breaking operations without the previous necessity of changing out excavating apparatus on the boom stick. A specially designed electrical and hydraulic circuit is provided which permits the positional control of both the bucket and the breaker with the same control device typically used to control the pivotal orientation Of an excavating bucket.

11 Claims, 4 Drawing Sheets

COMBINATION BUCKET/BREAKER APPARATUS FOR EXCAVATOR BOOM STICK

BACKGROUND OF THE INVENTION

The present invention generally relates to material handling apparatus and, in a preferred embodiment thereof, more particularly relates to excavating apparatus, representatively a tracked excavator, having operatively attached to the stick portion of its boom a specially designed combination bucket and breaker structure which uniquely permits the excavator operator to selectively carry out either digging or refusal material breaking tasks without having to change out equipment on the stick.

Large scale earth excavation operations are typically performed using a powered excavating apparatus, such as a tracked excavator, having an articulated, hydraulically pivotable boom structure with an elongated, pivotal outer end portion commonly referred to as a "stick". Secured to the outer end of the stick is an excavating bucket which is hydraulically pivotable relative to the stick between "closed" and "open" positions. By pivotally manipulating the stick, with the bucket swung to a selected operating position, the excavator operator uses the bucket to forcibly dig into the ground, scoop up a quantity of dirt, and move the scooped up dirt quantity to another location, such as into the bed of an appropriately positioned dump truck.

A common occurrence during this conventional digging operation is that the bucket strikes refusal material (in excavation parlance, a material which "refuses" to be dug up) such as rock which simply cannot be broken and scooped up by the bucket when this occurs it is typical practice to stop the digging operation, remove the bucket from the stick, and install a hydraulically operated "breaker" on the outer end of the stick in place of the removed bucket. The breaker has, on its outer end, an oscillating tool portion which rapidly hammers the refusal material in a manner breaking it up into portions which can be subsequently dug up. After the breaker has been utilized to break up the refusal material, the operator removes the breaker from the stick, replaces the breaker with the previously removed bucket, and resumes the digging operation with the bucket.

While this procedure is easy to describe, it is a difficult, laborious and time consuming task for the operator to actually carry out due to the great size and weight of both the bucket and breaker which must be attached to and then removed from the breaker, and the necessity for the operator to climb into and out of the high cab area of the excavator (often in inclement weather) to effect each bucket and breaker changeout on the stick. This sequence of bucket/breaker/bucket changeout, of course, must be laboriously repeated each time a significant refusal area is encountered in the overall digging process.

A previously utilized alternative to this single excavator sequence, is to simply provide two excavators for each digging project—one excavator having a bucket attached to its boom stick, and the second excavator having a breaker attached to its boom stick. When the bucket-equipped excavator encounters refusal material during the digging process, it is simply moved away from the digging site, and the operator climbs down from the bucket-equipped excavator, walks over to and climbs up into the breaker-equipped excavator, drives the breaker-equipped excavator to the digging site, and breaks up the encountered refusal material. Reversing the process, the operator then switches to the bucket-equipped excavator and resumes the digging process to scoop up the now broken-up refusal material.

While this digging/breaking technique is easier on the operator, it is necessary to dedicate two large and costly excavators to a given digging task, thereby substantially increases the total cost of a given excavation task. A modification of this technique is to use two operators—one to operate the bucket-equipped excavator, and one to operate the breaker-equipped excavator. This, of course, undesirably increases both the manpower and equipment cost for a given excavation project.

As can be readily appreciated from the foregoing, a need exists for an improved technique for carrying out the requisite digging and refusal material breaking portions of an overall excavation operation in a manner eliminating or at least substantially eliminating the above-mentioned problems, limitations and disadvantages commonly associated with conventional digging and breaking operations. It is to this need that the present invention is directed.

SUMMARY OF THE INVENTION

In carrying out principles of the present invention, in accordance with a preferred embodiment thereof, an excavating machine, representatively a tracked excavator, is provided with a specially designed pivotable boom stick assembly that includes a boom stick having first and second excavating tools secured thereto for movement relative to the boom stick. Illustratively, the first excavating tool is an excavating bucket secured to the boom stick for pivotal movement relative thereto between a first position and a second position, and the second tool is a breaker secured to the boom stick for pivotal movement relative thereto between a stowed position and an operative position.

Hydraulically operable drive apparatus is interconnected between the boom stick and the bucket and breaker and is useable to pivotally move the bucket between its first and second positions, and to pivotally move the breaker between its stowed and operative positions. Representatively, the drive apparatus includes a plurality of hydraulic cylinder assemblies operatively interconnected between the boom stick and the bucket and breaker.

The bucket, when the breaker is in its stowed position, is movable by the drive apparatus to the second bucket position and is useable in conjunction with the boom stick, and independently of the breaker, to perform a digging operation. The breaker, when the bucket is in its first position, is movable by the drive apparatus to the breaker's operative position and is useable in conjunction with the boom stick, and independently of the bucket, to perform a breaking operation. Accordingly, the excavating machine may be advantageously utilized to perform both digging and breaking operations without equipment changeout on the boom stick.

In an illustrated preferred embodiment thereof, the excavating machine is also provided with control circuitry coupled to the drive apparatus and useable to operate it. Representatively, the control circuitry includes a hydraulic flow circuit in which the drive apparatus is interposed; a flow controller operative to selectively reverse the direction of hydraulic fluid flow through a portion of the hydraulic flow circuit; diverting valve apparatus interconnected in the hydraulic flow circuit and operable to selectively route hydraulic fluid through the hydraulic flow circuit to (1) a first portion of the drive apparatus associated with the bucket, or (2) a second portion of the drive apparatus associated with the breaker; and a switch structure useable to selectively operate the diverting valve apparatus.

DETAILED DESCRIPTION

Figure 1:
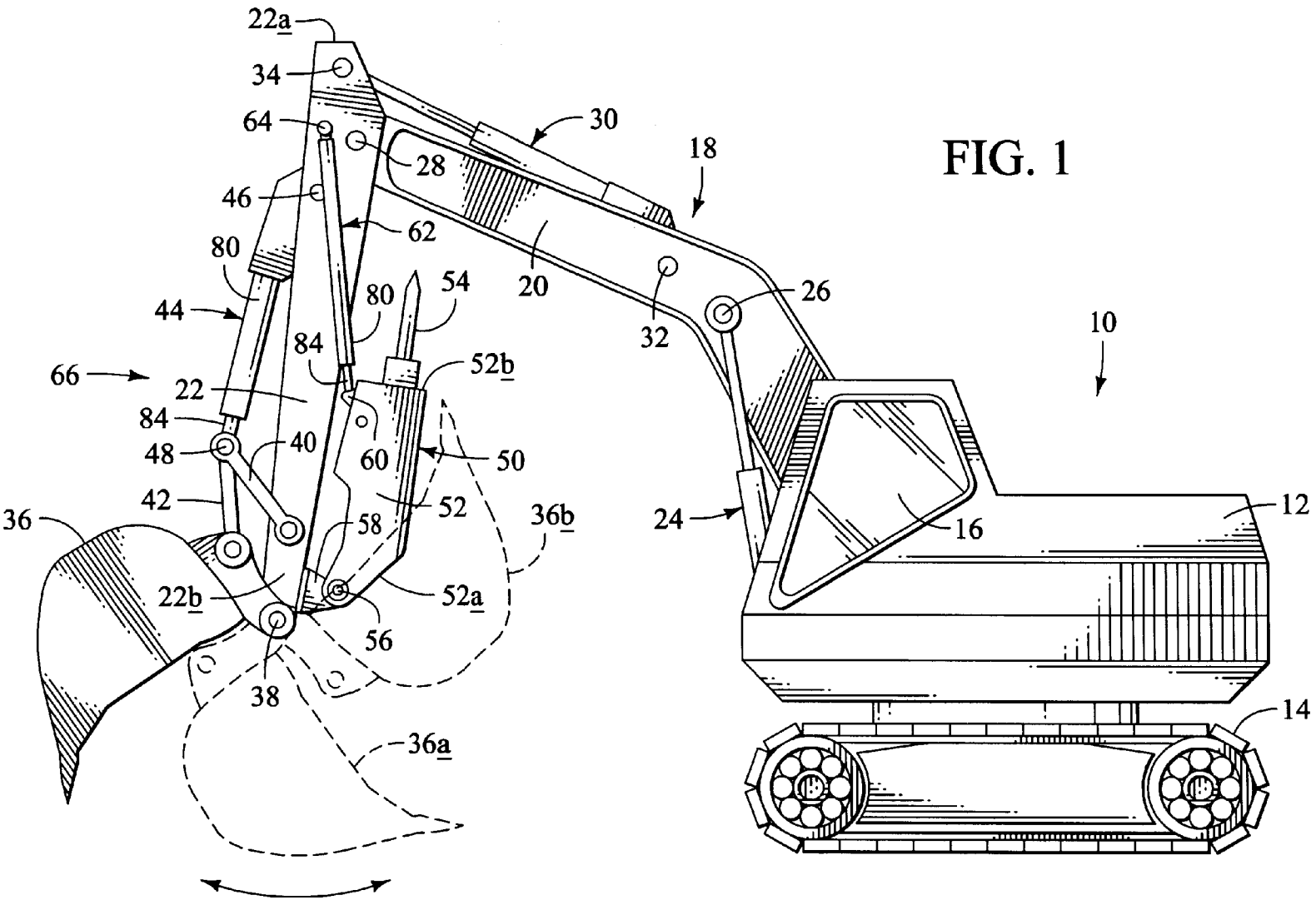
FIGS. 1 and 2 are simplified, somewhat schematic side elevational views of a representative excavating machine illustrating the variable positioning available for a bucket and breaker simultaneously carried by the stick portion of its boom.
Figure 2:
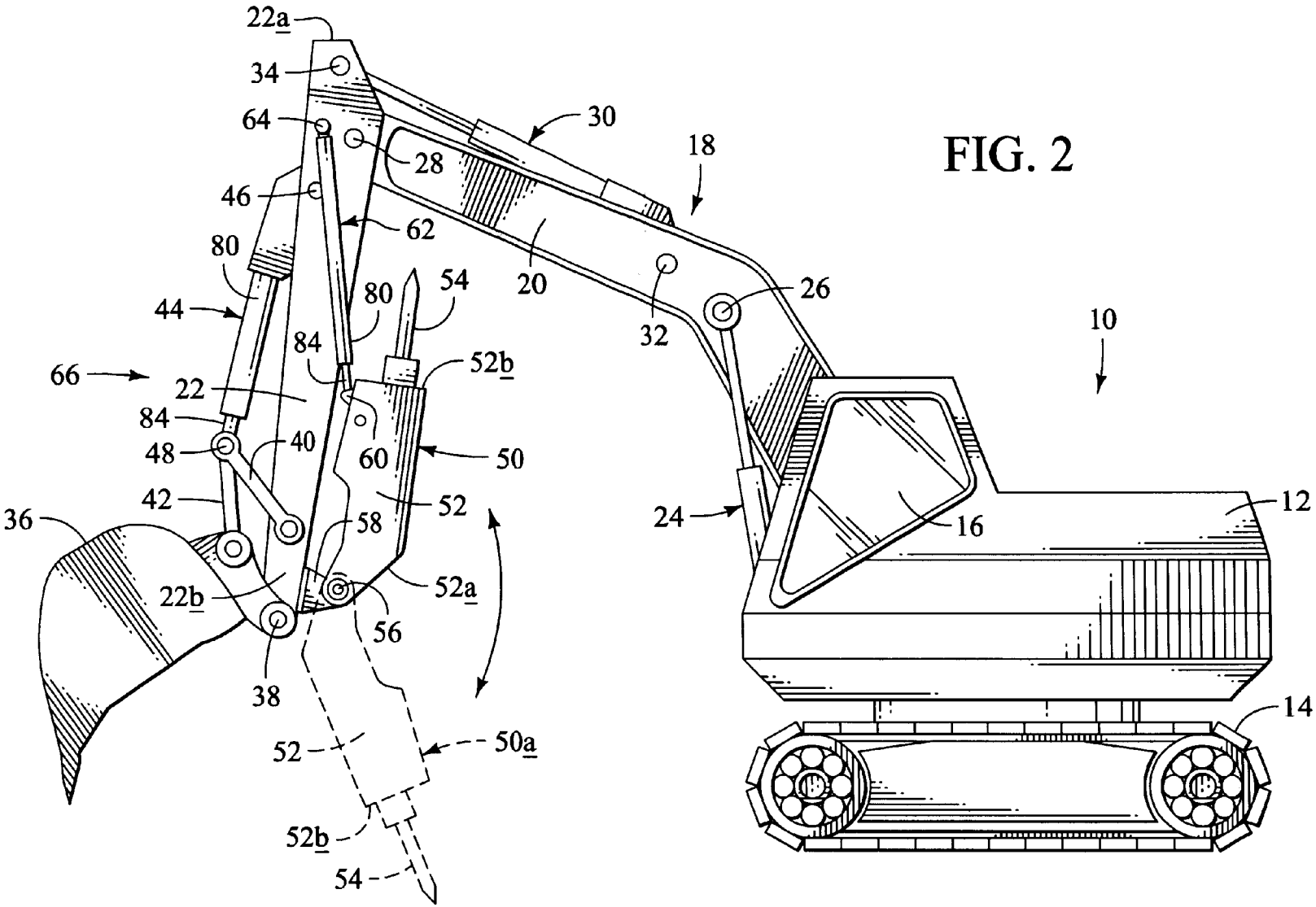

Illustrated in simplified form in FIGS. 1 and 2 is an earth excavating machine which is representatively in the form of a tracked excavator 10 having a body portion 12 supported atop a wheeled drive track section 14 and having an operator cab area 16 at its front or left end. While a tracked excavator has been illustrated, it will be readily appreciated by those of skill in this particular art that the principles of the present invention, as later described herein, are equally applicable to other types of earth excavating machines including, but not limited to, a wheeled excavator and a rubber-tired backhoe.

A conventional articulated boom structure 18 projects forwardly from the excavator body portion 12 and includes an elongated base portion 20 and a stick portion 22. The right or inner end of the boom base portion 20 is pivotally secured to the body portion, adjacent the front end thereof, and the boom base portion 20 is pivotable in a vertical plane, toward and away from the ground, by means of hydraulic cylinder assemblies 24 (only one of which is visible in FIGS. 1 and 2) disposed on opposite sides of the boom base portion 20 and interconnected between a pivot location (not visible) on the excavator body portion 12 and a pivot location 26 on the boom base portion 20.

The upper end 22*a* of the boom stick 22 is connected to the left or outer end of the boom base portion 20, at pivot location 28, and is forcibly pivotable in a vertical plane about location 28, toward and away from the front end Of the excavator body 12, by means of a hydraulic cylinder assembly 30 operatively interconnected between a pivot location 32 on the boom base portion 20 and a pivot location 34 on the upper end 22*a* of the boom stick 22.

A conventional excavating bucket 36 is pivotally secured the lower end 22*b* of the stick 22, at pivot location 38, and is further secured to the lower end of the stick 22 by a conventional pivotal drive bar linkage 40,42. A hydraulic cylinder assembly 44 is pivotally interconnected between a pivot location 46 on the upper end 22*a* of the stick 22 and a pivot location 48 on the drive bar linkage 40,42. The hydraulic cylinder assembly 44 may be utilized to pivot the bucket 36 relative to the lower end 22*b* of the stick, in a vertical plane toward and away from the front end of the excavator body 12, between (1) a solid line, fully open position (see FIGS. 1 and 2) in which the bucket 36 is disposed on the front side of the stick 22 with its open side facing generally downwardly, and (2) a dotted line, fully open position 36*b* (see FIG. 1) in which the bucket 36 is disposed on the right side of the stick 22 with its open side facing generally upwardly. And, of course, the bucket 36 may be pivoted to a selected dotted line operating position 36*a* (see FIG. 1) somewhere between these two pivotal limit positions.

According to a key aspect of the present invention, a hydraulic breaker device 50 is mounted on the stick 22 in addition to the excavating bucket 36. in a manner subsequently described herein, this permits the same powered excavating apparatus 10 to uniquely perform both digging and breaking operations without the previous necessity of having to perform repeated tool changeouts on the stick 22 or having to provide two separate powered excavating machines—one to dig and one to break.

The breaker 50 has a body section 52 with inner and outer ends 52*a* and 52*b*. Carried on the outer end 52*a* is an elongated, longitudinally reciprocable breaking tool 54 which is forcibly reciprocated in response to selective transmittal to the breaker 50 of pressurized hydraulic fluid via suitable hydraulic lines (not shown). The inner breaker body end 52*a* is pivotally connected, at pivot location 56, to a suitable mounting bracket 58 anchored to the lower stick end 22*b* and projecting outwardly from its rear side. The outer breaker body end 52*b* is pivotally connected, at pivot location 60, to the rod ends Of a pair of hydraulic cylinder assemblies 62 (only one of which is visible in FIGS. 1 and 2) pivotally connected at their opposite ends to the upper stick end 22*a* at pivot location 64.

Hydraulic cylinder assemblies 62 are selectively operable, as later described herein, to forcibly pivot the breaker 50 between (1) a solid line stowed or fully open position (see FIGS. 1 and 2) in which the breaker body 52 extends upwardly along and generally parallel to the inner side of the stick 22, with the reciprocable breaker tool 54 positioned adjacent the upper stick end 22*a*, and (2) a dotted line fully closed operational position 50*a* (see FIG. 2) in which the breaker body extends downwardly beyond the lower stick end 22*b*, at an obtuse angle to the length of the stick 22, with the reciprocable breaker tool 54 pointing downwardly as viewed in FIG. 2. Of course, the breaker 50 may also be positioned at any selected pivotal orientation between these two illustrated pivotal limit positions.

As can be seen by comparing FIGS. 1 and 2, with the breaker 50 in its solid line stowed orientation (see FIGS. 1 and 2), the bucket 36 may be freely pivoted between its solid and dotted line limit positions 36 and 36*b* (see FIG. 1), and used in digging operations, without interference from the stowed breaker 50. Similarly, with the bucket 36 in its fully open solid line pivotal orientation (see FIGS. 1 and 2), the breaker 50 can be swung downwardly from its solid line stowed orientation (see FIGS. 1 and 2) to a selected dotted line operating orientation (see FIG. 2), and used to break up refusal material, without interference from the bucket 36. Thus, either one of the bucket 36 and the breaker 50 may be used independently of the other device without the necessity of excavation equipment changeout on the boom stick 22.

The present invention thus provides an excavating machine or apparatus having a uniquely operative boom stick assembly 66 (see FIGS. 1 and 2) which includes the stick 22, two independently operable excavation tools (representatively, the excavating bucket 36 and the breaker 50) each carried on the stick 22 for movement relative thereto between first and second limit positions, and drive apparatus (representatively the hydraulic cylinder assemblies 44,62) interconnected between the stick 22 and the bucket 36 and breaker 50 and operable to variably position them relative to the stick 22.

Using the representative excavating machine 10, a typical digging and breaking operation can be carried out as follows. With the breaker 50 in its solid line stowed orientation (see FIGS. 1 and 2), and the bucket 36 pivoted to a suitable operational orientation (for example the dotted line orientation 36*a* shown in FIG. 1), the operator carries out a digging operation in a conventional manner. When refusal material, such as rock, is encountered and cannot be scooped up with the bucket 36, the operator simply pivots the bucket 36 back to its fully open, solid line position (see FIGS. 1 and 2), pivots the breaker 50 away from its solid line stowed orientation (see FIGS. 1 and 2) to a selected operational orientation (for example, the dotted line orientation 50*a* shown in FIG. 2), and hydraulically operates the breaker 50 to break up the refusal material.

After this breaking task is completed, the operator simply pivots the deployed breaker 50 back to its solid line, stowed orientation (see FIG. 2), pivots the bucket 36 away from its solid line fully open orientation (see FIG. 1) to a selected dotted line orientation, scoops up the now broken refusal material, and resumes the digging operation using the bucket 36. Accordingly, both the digging and breaking portions of an overall excavation task may be performed by the machine operator without leaving the cab area 16 or having to effect an equipment changeout on the stick 22.

Figure 3A:
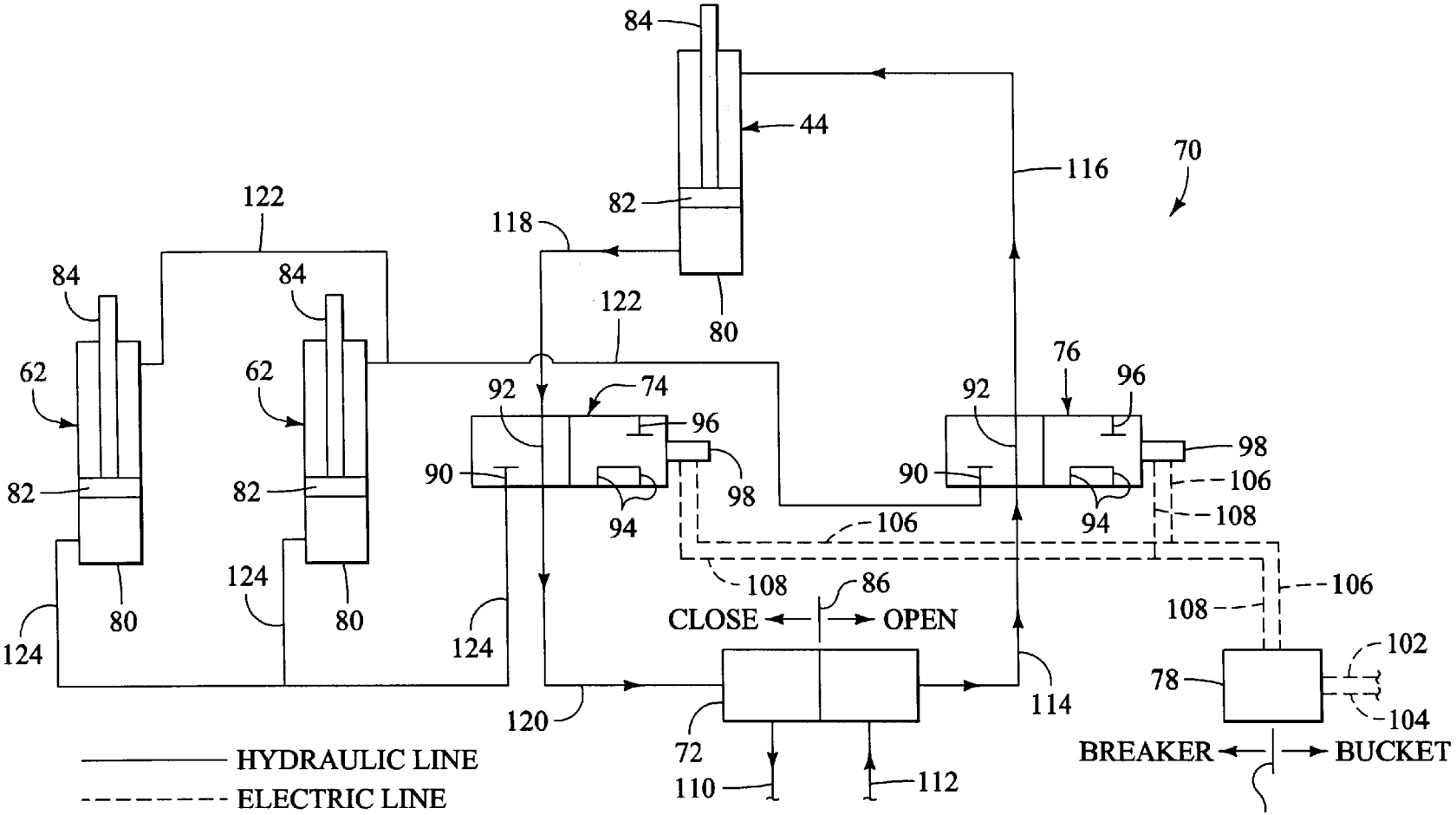
FIGS. 3A and 3B are schematic diagrams of a specially designed hydraulic and electrical circuit used to control the pivotal orientations of the bucket and breaker relative to the boom stick.
Figure 3B:
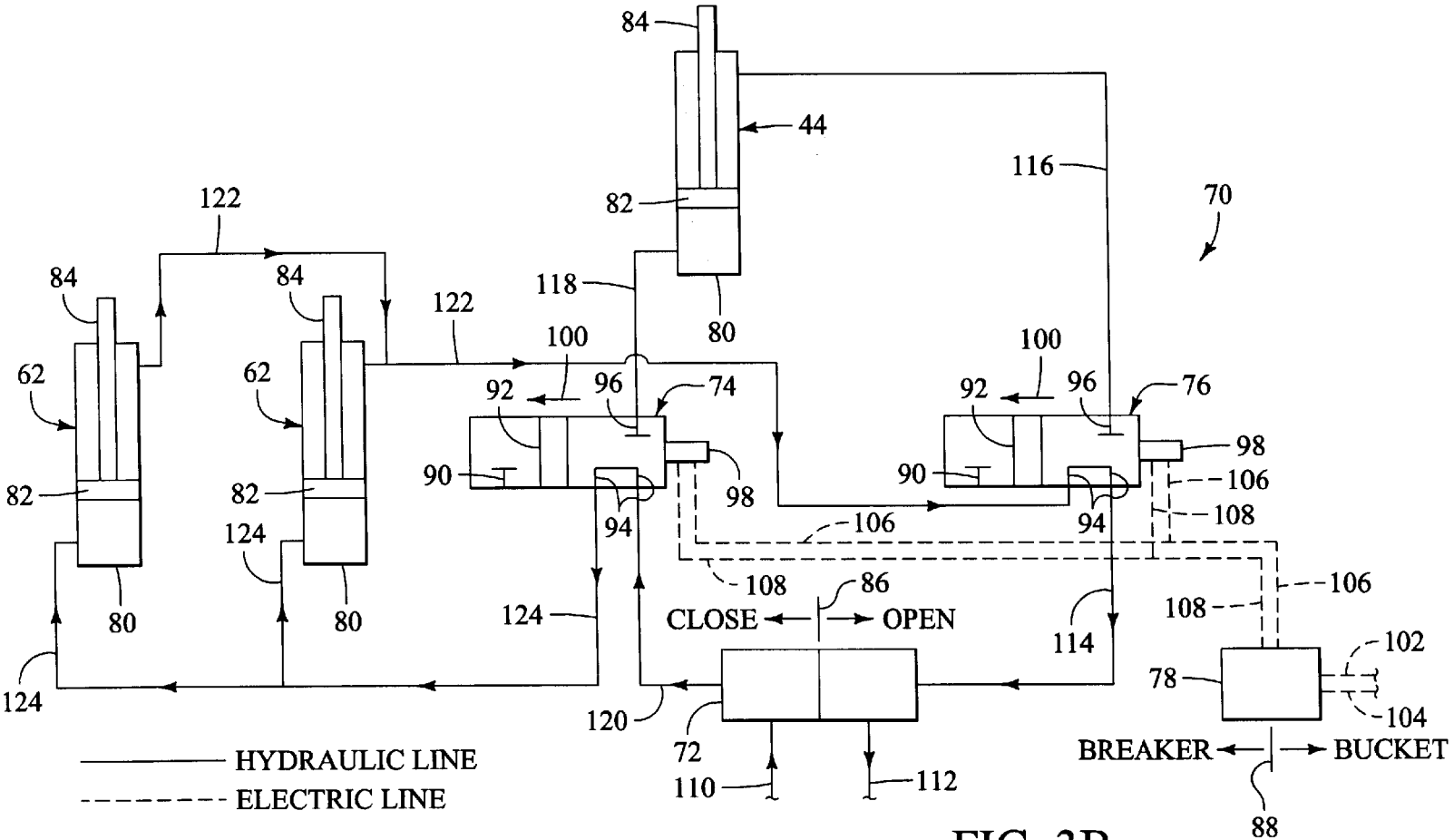

Schematically depicted in FIGS. 3A and 3B is a specially designed hydraulic/electric circuit 70 used to selectively pivot the bucket 36 and the breaker 50 between their previously described limit positions relative to the stick 22. Circuit 70 includes the bucket hydraulic cylinder assembly 44; the breaker hydraulic cylinder assemblies 62; a manually operable hydraulic bucket/breaker pivotal position controller 72; a pair of solenoid-operated hydraulic diverter valves 74,76; and an electrical bucket/breaker selecter switch 78.

Hydraulic cylinder assemblies 44 and 62 are of conventional construction, with each of them having a hollow cylinder 80, a piston 82 reciprocably mounted in the cylinder 80, and a rod 84 drivably connected to the piston 82 and extending outwardly through an end of the cylinder 80. The hydraulic bucket/breaker position controller 72 is appropriately positioned in the cab area 16 and has a control member 86 that may be manually moved in the indicated "close" and "open" directions. Similarly, the electrical bucket/breaker selector switch 78 is appropriately positioned in the cab area 16 and has a switch member 88 that may be manually toggled to either a "breaker" position or a "bucket" position. Each of the hydraulic diverter valves 74,76 has, from left to right as viewed in FIGS. 3A and 3B, a dead end port 90, a through-flow passage 92, an interconnected pair of turnaround ports 94, and a dead end port 96. Additionally, each valve 74,76 has an electrical solenoid portion 98 operative as later described herein to shift the porting in its associated valve as schematically indicated by the arrows 100 in FIG. 3B.

DC electrical power supply lines 102,104 are connected to the input side Of the bucket/breaker selector switch 78, and DC electrical control output lines 106,108 are interconnected between the output side of the switch 78 and the valve solenoids 98. With the selector switch member 88 toggled to its "bucket" position, no electrical power is supplied to the solenoids 98, and the ports and passages 90,92,94,96 of the hydraulic diverter valves 74,76 are in their FIG. 3A orientations relative to the balance of the schematically depicted circuit 70. When the selector switch member 88 is toggled to its "breaker" position, DC electrical power is transmitted to the solenoids 98 via electrical lines 106 and 108 to thereby shift the valve porting leftwardly relative to the balance of the circuit 70 as schematically indicated by the arrows 100 in FIG. 3B.

With the electrical switch member 88 in its "bucket" position, the hydraulic cylinder assemblies 44 and 62, the hydraulic position control 72, and the hydraulic diverter valves 74 and 76 are hydraulically interconnected as follows as viewed in the schematic FIG. 3A circuit diagram.

Main hydraulic power lines 110,112 are connected to the bottom side of the position controller 72; hydraulic line 114 is interconnected between the right end of the position controller 72 and the through-flow passage 92 of the diverter valve 76; hydraulic line 116 is interconnected between the through-flow passage 92 of diverter valve 76 and the upper end of the cylinder portion 82 of the bucket hydraulic cylinder assembly 44; hydraulic line 118 is interconnected between the lower end of the cylinder portion 82 of the bucket hydraulic cylinder assembly 44 and the through-flow passage 92 of the diverter valve 74; and hydraulic line 120 is interconnected between the through-flow passage 92 of diverter valve 74 and the left end of the position controller 72. Hydraulic line 122 is interconnected between the dead end port 90 of the diverter valve 76 and the upper ends of the cylinder portions 80 of the breaker hydraulic cylinder assemblies 62; and hydraulic line 124 is interconnected between the dead end port 90 Of the diverter valve 74 and the lower ends of the cylinder portions 80 of the breaker hydraulic cylinder assemblies 62.

Referring to FIG. 3A, with the electrical selector switch member 88 toggled to its "bucket" position, the position controller 72 is useable to control the pivotal orientation of the bucket 36 relative to the stick 22 (see FIG. 1) when the breaker 50 is in its solid line stowed orientation. For example, when the hydraulic control member 86 is moved toward the "open" position, hydraulic fluid is sequentially flowed (as indicated in the arrowed hydraulic portion of the circuit 70 in FIG. 3A) through hydraulic lines 112 and 114, the through-flow passage 92 of the diverter valve 76, hydraulic line 116, the interior of the cylinder portion 80 of the bucket hydraulic cylinder assembly 44, hydraulic line 118, the through-flow passage 92 Of the diverter valve 74, and the hydraulic lines 120 and 110. This hydraulic flow retracts the rod 84 of the bucket hydraulic cylinder assembly 44 to thereby pivot the bucket 36 in a clockwise direction away from its fully closed orientation 36*b* in FIG. 1. Conversely, when the position control member 86 is shifted in a "close" direction, the hydraulic flow through this arrowed hydraulic portion of the circuit 70 is reversed, thereby forcibly extending the rod 84 of the bucket hydraulic cylinder assembly 44 and pivoting the bucket 36 in a counterclockwise direction toward its fully closed dotted line orientation 36*b* shown in FIG. 1.

Turning now to FIG. 3B, when it is desired to use the breaker 50 instead of the bucket 36, the bucket 36 is pivoted to its fully open solid line position shown in FIG. 1, and the electrical bucket/breaker switch member 88 is toggled to its "breaker" position to thereby supply electrical power, via leads 106 and 108, to the solenoids 98 of the hydraulic diverter valves 74,76. This, in turn, causes the porting of the valves 74,76 to shift leftwardly (as viewed in FIG. 3B) as schematically indicated by the arrows 100. After such port shifting (see FIG. 3B), hydraulic lines 120,124 are coupled as shown to the interconnected turnaround ports 94 in valve 74, and the hydraulic lines 114,122 are coupled to the interconnected turnaround ports 94 in valve 76.

Next, the hydraulic control member 86 is moved in its "close" direction. In response, hydraulic fluid is sequentially flowed (as indicated in the arrowed hydraulic portion of the circuit 70 in FIG. 3B) through hydraulic lines 110 and 120, the interconnected turnaround ports 94 in diverter valve 74, hydraulic line 124, the interiors of the cylinder portions 80 of the breaker hydraulic cylinder assemblies 62, the hydraulic line 122, the interconnected turnaround ports 94 in the diverter valve 76, and the hydraulic lines 114 and 112. This hydraulic flow forcibly extends the rod portions 84 of the breaker hydraulic cylinder assemblies 62 to thereby forcibly pivot the stowed breaker 50 (see FIG. 2) downwardly to a selected operating orientation such as the dotted line position 50*a* in FIG. 2. The now operationally positioned breaker 50 may be hydraulically operated, to cause the reciprocation of its tool portion 54, using a conventional hydraulic breaker control (not shown) suitably disposed in the cab area 16 of the representative excavating apparatus 10. After the breaker 50 has been used, the circuit 70 can be utilized to swing the breaker 50 back up to its stowed orientation and then swing the bucket 36 back down to a selected operational orientation thereof.

As will be readily appreciated by those of skill in this particular art, the excavation apparatus 10 may be easily retrofitted to provide it with both digging and breaking capabilities as previously described herein by simply connecting the breaker 50 and its associated hydraulic drive cylinder apparatus 62 to the stick 22, and modifying the existing bucket positional control circuitry (for example, as shown in FIGS. 3A and 3B) to add positional control capabilities for the added breaker 50. In this regard it should be noted that the position controller 72 shown in the circuit diagrams of FIGS. 3A and 3B may be the existing bucket position controller. With the simple addition of the diverter valves 74 and 76, the bucket/breaker selector switch 78, and additional hydraulic lines, the operator can select and independently control both the bucket 36 and the breaker 50.

While the excavating apparatus 10 may be retrofitted by adding the breaker 50 and its associated cylinder assemblies 62 to the stick 22 to complement its existing bucket 36, the overall stick assembly 66 (see FIGS. 1 and 2) may be alternatively provided as a total replacement for the existing stick and its associated excavating bucket.

A variety of modifications may be made to the illustrated embodiment of the present invention without departing from the principles of such invention. For example, as previously mentioned, aspects of the invention can be advantageously utilized on a variety of types of excavating machines other than the representatively illustrated tracked excavator 10. Additionally, while the hydraulic/electric circuit 70 permits the selected positional control of either the bucket 36 or the breaker 50, other types of control circuitry may be alternatively utilized, if desired, including separate hydraulic circuits for the bucket and the breaker. Moreover, while the independently utilizable tools mounted on the stick 22 are representatively an excavating bucket and a breaker, other independently utilizable excavating tools could be mounted on the stick in place of the illustrated bucket and breaker. Also, while the illustrated bucket and breaker are shown as being pivotally mounted to the stick, the particular independently operable tools selected for mounting on the stick could have alternate positional movements, such as translation, relative to the boom stick on which they are mounted.

The foregoing detailed description is to be clearly understood as being given by way of illustration and example, the spirit and scope of the present invention being limited solely by the appended claims.

What is claimed is:

1. A boom stick assembly for use on an excavating machine, comprising:

a boom stick;

a bucket secured to said boom stick for pivotal movement relative thereto between a first position and a second position;

a breaker secured to said boom stick for pivotal movement relative thereto between a stowed position and an operative position; and hydraulically operable drive apparatus interconnected between said boom stick and said bucket and breaker and useable to pivotally move said bucket between said first and second positions and to pivotally move said breaker between said stowed and operative positions, said bucket, when said breaker is in said stowed position, being movable by said drive apparatus to said second position and useable in conjunction with said boom stick to perform a digging operation, said breaker, when said bucket is in said first position, being movable by said drive apparatus to said operative position and useable in conjunction with said boom stick to perform a breaking operation, whereby said boom stick assembly may be used to perform both digging and breaking operations without equipment changeout thereon.

2. An excavating machine comprising:

a body;

a boom structure extending outwardly from said body and including a pivotable boom stick;

a bucket secured to said boom stick for pivotal movement relative thereto between first and second positions;

a breaker secured to said boom stick for pivotal movement relative thereto between first and second positions, said bucket, when in said second position thereof, being useable in an excavation operation independently of said breaker when said breaker is in said first position thereof, said breaker, when in said second position thereof, being useable in an excavation operation independently of said bucket when said bucket is in said first position thereof; and drive apparatus carried by said boom stick and being operable to forcibly move either selected one of said bucket and said breaker between its first and second positions.

3. The excavating machine of claim 2 wherein said excavating machine is a tracked excavator.

4. The excavating machine of claim 2 wherein said drive apparatus includes a plurality of hydraulic cylinder assemblies operatively interconnected between said boom stick and said bucket and said breaker.

5. The excavating machine of claim 2 further comprising control circuitry coupled to said drive apparatus and useable to operate it.

6. The excavating machine of claim 5 wherein said control circuitry includes:

a hydraulic flow circuit in which said drive apparatus is interposed, a flow controller operative to selectively reverse the direction of hydraulic fluid flow through a portion of said hydraulic flow circuit, diverting valve apparatus interconnected in said hydraulic flow circuit and being operable to selectively route hydraulic fluid through said hydraulic flow circuit to (1) a first portion of said drive apparatus associated with said bucket, or (2) a second portion of said drive apparatus associated with said breaker, and a switch structure useable to selectively operate said diverting valve apparatus.

7. The excavating machine of claim 6 wherein said excavating machine is a tracked excavator.

8. An excavating machine comprising:

a body;

a boom structure extending outwardly from said body and including a pivotable boom stick;

a bucket secured to said boom stick for pivotal movement relative thereto between a first position and a second position;

a breaker secured to said boom stick for pivotal movement relative thereto between a stowed position and an operative position; and hydraulically operable drive apparatus interconnected between said boom stick and said bucket and breaker and useable to pivotally move said bucket between said first and second positions and to pivotally move said breaker between said stowed and operative positions, said bucket, when said breaker is in said stowed position, being movable by said drive apparatus to said second position and useable in conjunction with said boom stick to perform a digging operation, said breaker, when said bucket is in said first position, being movable by said drive apparatus to said operative position and useable in conjunction with said boom stick to perform a breaking operation; and control circuitry coupled to said drive apparatus and useable to operate it, whereby said excavating machine may be used to perform both digging and breaking operations without equipment changeout on said boom stick.

9. The excavating machine of claim 8 wherein said excavating machine is a tracked excavator.

10. The excavating machine of claim 8 wherein said control circuitry includes:

a hydraulic flow circuit in which said drive apparatus is interposed, a flow controller operative to selectively reverse the direction of hydraulic fluid flow through a portion of said hydraulic flow circuit, diverting valve apparatus interconnected in said hydraulic flow circuit and being operable to selectively route hydraulic fluid through said hydraulic flow circuit to (1) a first portion of said drive apparatus associated with said bucket, or (2) a second portion of said drive apparatus associated with said breaker, and a switch structure useable to selectively operate said diverting valve apparatus.

11. The excavating machine of claim 10 wherein said excavating machine is a tracked excavator.

* * * * *

UNITED STATES PATENT AND TRADEMARK OFFICE

CERTIFICATE OF CORRECTION

PATENT NO. : 6,430,849 B1
DATED : August 13, 2002
INVENTOR(S) : Lowell A. Underwood It is certified that error appears in the above-identified patent and that said Letters Patent is hereby corrected as shown below:

Title page,
Item [57], ABSTRACT, in the last line, delete "Of" and insert therefor -- of --.

Column 1,
Line 32, BACKGROUND OF THE INVENTION, please delete "bucket when" and insert therefor -- bucket. When --.

Column 4,
Line 13, delete "ends Of" and insert therefor -- ends of --.

Column 5,
Line 46, please delete "side Of" and insert therefor -- side of --.

Column 6,
Line 15, please delete "port 90 Of" and insert therefor -- port 90 of --.
Line 30, please delete "passage 92 Of" and insert therefor -- passage 92 of --.

Signed and Sealed this

Fifteenth Day of April, 2003

JAMES E. ROGAN
*Director of the United States Patent and Trademark Office*